US007150229B2

(12) United States Patent
Gardner

(10) Patent No.: US 7,150,229 B2
(45) Date of Patent: Dec. 19, 2006

(54) PROJECTILE WAD FOR AMMUNITION CARTRIDGES

(75) Inventor: Robert J. Gardner, Bethalto, IL (US)

(73) Assignee: Olin Corporation, East Alton, IL (US)

( * ) Notice: Subject to any disclaimer, the term of this patent is extended or adjusted under 35 U.S.C. 154(b) by 311 days.

(21) Appl. No.: 10/832,879

(22) Filed: Apr. 27, 2004

(65) Prior Publication Data

US 2005/0235860 A1 Oct. 27, 2005

(51) Int. Cl.
*F42B 7/08* (2006.01)

(52) U.S. Cl. ..... 102/451; 102/453; 102/461; 102/532

(58) Field of Classification Search ..... 102/449, 102/532, 451, 448, 450, 453, 461, 502, 454, 102/455, 457, 458, 459, 460, 444
See application file for complete search history.

(56) References Cited

U.S. PATENT DOCUMENTS 3,289,586 A * 12/1966 Horn et al. ..... 102/450
3,298,313 A * 1/1967 Comerford ..... 102/451
3,835,783 A * 9/1974 Curran ..... 102/451
3,974,775 A * 8/1976 Kerzman et al. ..... 102/451
4,970,959 A * 11/1990 Bilsbury et al. ..... 102/450
5,710,391 A * 1/1998 Chetcuti ..... 102/430
6,164,209 A 12/2000 Best et al. ..... 102/450
6,415,719 B1 * 7/2002 Buccelli et al. ..... 102/457

* cited by examiner

*Primary Examiner*—Michael J. Carone
*Assistant Examiner*—James S. Bergin
(74) *Attorney, Agent, or Firm*—Harness, Dickey & Pierce, P.L.C.

(57) ABSTRACT

An ammunition cartridge includes: a basewad disposed within a tube proximate the aft end of the tube; a projectile wad disposed within the tube proximate a fore end of the tube; a propellant charge disposed within a chamber formed between the projectile wad and the basewad; and a projectile disposed within the tube between a forward facing surface of the projectile wad and the fore end of the tube. The aft end of the projectile wad has a powder cup skirt formed thereon, and a chamfer is formed around an outer perimeter of a lip of the powder cup skirt. The chamfer allows the powder cup skirt to be slidably received within a skirt of the basewad to form the chamber. The chamfer provides a clearance at the powder cup skirt lip, which helps to insure undisturbed entry into the mouth of the basewad skirt.

26 Claims, 6 Drawing Sheets

SECTION A–A

SECTION B–B

PROJECTILE WAD FOR AMMUNITION CARTRIDGES

BACKGROUND OF THE INVENTION

1. Field of the Invention

The invention relates to ammunition cartridges such as shotgun shells and the like. More particularly, the invention relates to projectile wads for ammunition cartridges.

2. Description of Related Art

FIG. 1 depicts a typical ammunition cartridge 20, which includes: a tube 24, a basewad 26, a metal head 28, and a projectile wad 44. An example of such an ammunition cartridge 20 is the WINCHESTER XPERT® shotshell by Olin Corporation, East Alton, Ill. The tube 24 is typically formed of plastic and may be of a type known the Reifenhauser tube. At the aft end 30 of the ammunition cartridge 20, the basewad 26 is inserted in a tight fitting relation into the aft end of the tube 24. The cup-shaped metal head 28 surrounds an aft portion of the tube 24 and is crimped to the outwardly-flared aft end of the tube 24 and basewad 26 to mechanically secure the three together and form an annular rim 32, which is useful to assist in extraction of the ammunition cartridge 20 from a shotgun (not shown). A central aperture 34 in the metal head 28 is co-aligned with a pocket 36 in the basewad to accommodate a battery cup-type primer 38 in press fit relation. The basewad 26 has a forward surface 42 that defines a portion of a powder chamber for receiving a propellant charge 40. The projectile wad 44 has an aft surface 43 forming an over-powder cup (powder cup), which typically bounds most of the remainder of the powder chamber. In the ammunition cartridge 20 shown in FIG. 1, the aft rim 45 of the projectile wad 44 is close to contacting a forward rim 46 of the basewad 26. Thus, between the aft rim 45 and the forward rim 46, the powder chamber may be bounded by a cylindrical segment of the interior surface 47 of the tube 24.

In the design of ammunition cartridges, a number of advancements have been made to improve the sealing of combustion gases against infiltration between the basewad 26 and tube 24. For example, U.S. Pat. No. 6,164,209 to Best et al. (the '209 patent) discloses an ammunition cartridge including a projectile wad having an aft portion located at least partially concentrically within a skirt of the basewad so as to define a powder chamber for containing the propellant charge. Upon firing of the ammunition cartridge, the pressure increase produces a radially outward force on the powder cup, causing the powder cup to expand radially and bear against the basewad to maintain a seal against escape of propellant combustion gasses from the powder chamber. Also, the basewad expands radially to seal combustion gasses against infiltration between the basewad and tube.

While the ammunition cartridge design described in the '209 patent is successful in improving the sealing of combustion gasses, room for improvement exists. For example, the ammunition cartridge described in the '209 patent includes a long, thin tapered basewad skirt that is designed to accept the projectile wad powder cup within an open end (mouth). The basewad skirt tapers to a sharp edge at the lip. This sharp edge is delicate and susceptible to damage at numerous points in the manufacturing process and during handling and conveying. It is not uncommon for the lip of the basewad skirt to have several minor dings and dents that cause inward deformation of material. This creates locations for the square edge of the powder cup skirt to catch as it is inserted into the shell, causing the powder cup to tip and seat improperly at an angle. Improper alignment of the powder cup can result in low report on firing and, in extreme cases, a bulge is created in the ammunition cartridge sidewall large enough to prevent chambering in the shotgun. Accordingly, care is taken during the manufacturing process to avoid powder cup misalignment, and any ammunition cartridges having a misaligned powder cup are discarded, which increases the production cost of the ammunition cartridges.

BRIEF SUMMARY OF THE INVENTION

The above-described and other drawbacks and deficiencies of the prior art are overcome or alleviated by an ammunition cartridge comprising: a tube extending along a central longitudinal axis from an aft end of the tube to a fore end of the tube; a basewad disposed within the tube and located proximate the aft end of the tube; a projectile wad disposed within the tube; a propellant charge disposed within a chamber formed between the basewad and the projectile wad; and at least one projectile disposed within the tube between a forward facing surface of the projectile wad and the fore end of the tube. The basewad includes an interior surface extending outward and forward from a generally forward facing inner portion to a generally inward facing fore portion so as to define a skirt of the basewad. The projectile wad includes an interior surface extending outward and rearward from a generally aft facing inner portion to a generally inward facing aft portion so as to define a powder cup skirt. The powder cup skirt has a chamfer formed around an outer perimeter of a lip of the powder cup skirt, the lip being slidably received within the skirt of the basewad so as to form the chamber between the powder cup skirt and the skirt of the basewad. An end surface of the lip is substantially uninterrupted around the entire powder cup skirt.

In one aspect of the present invention, the powder cup skirt has a thickness $T_B$ at a transition point between the outer surface and the chamfer. The thickness $T_B$ is preferably between about 0.015 inches to about 0.028 inches, and more preferably between about 0.018 inches to about 0.024 inches.

In various embodiments, the powder cup skirt has an outside diameter of between about 0.690 inches to about 0.712 inches, and more preferably between about 0.695 inches to about 0.710 inches. In various alternative embodiments, the powder cup skirt has an outside diameter of between about 0.580 inches to about 0.600 inches, and more preferably between about 0.585 inches to about 0.595 inches.

In various embodiments, the chamfer has a forward facing cone angle of about 18 degrees relative to the central longitudinal axis. The transition point may be about 0.30 inches from an end surface of the lip. The lip may have a thickness of about 0.10 inches at the end surface of the lip. The powder cup skirt may have an outside diameter of between about 0.700 inches to about 0.712 inches.

The cartridge may further include a plurality of petals disposed at a perimeter of the forward facing surface, with the projectile being disposed between the plurality of petals. The cartridge may also further include a compressible shock absorbing midsection disposed between the forward facing surface and the interior surface of the projectile wad. A plurality of evenly spaced channels may be disposed along an outer surface of the powder cup skirt.

BRIEF DESCRIPTION OF THE DRAWINGS

The invention will be more fully understood from the following detailed description taken in conjunction with the accompanying drawings wherein like elements are numbered alike, and in which.

DETAILED DESCRIPTION OF THE INVENTION

Figure 2:
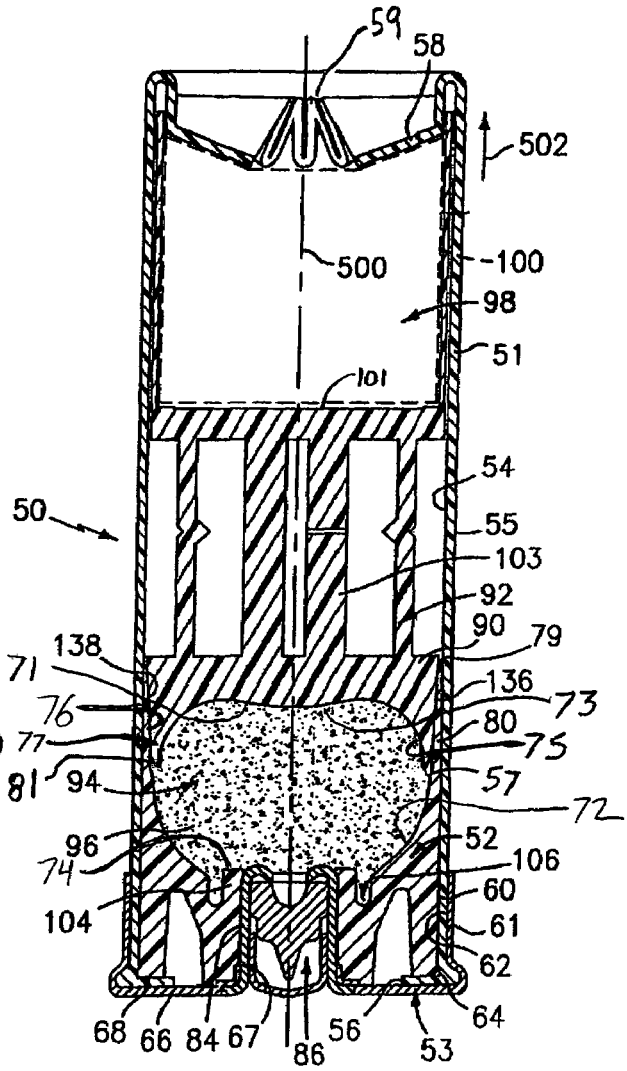
FIG. 2 is a longitudinal sectional view of an ammunition cartridge according to an embodiment of the present invention.

FIG. 2 depicts an ammunition cartridge 50 according to an embodiment of the present invention. The ammunition cartridge 50 includes: a tube 51 extending along a central longitudinal axis 500 from an aft end 56 to a fore end 59; a basewad 52 disposed within the tube 51 and located proximate the aft end 56; a projectile wad 92 disposed within the tube 51; a propellant charge 96 disposed within a chamber 94 formed between the projectile wad 92 and the basewad 52; and at least one projectile 100 disposed within the tube 51 between a forward facing surface 101 of the projectile wad 92 and the fore end 59 of the tube 51. The basewad 52 includes an interior surface 72 extending outward and forward from a generally forward facing inner portion 74 to a generally inward facing fore portion 76 so as to define a skirt 80 of the basewad 52. The projectile wad 92 includes an interior surface 71 extending outward and rearward from a generally aft facing inner portion 73 to a generally inward facing aft portion 75 so as to define a skirt 77 on an over-powder cup (powder cup) 90. The powder cup skirt 77 has a chamfer 81 formed around an outer perimeter of a lip 57 of the powder cup skirt 77, which allows the powder cup skirt 77 to be slidably received within the skirt 80 of the basewad 52 to form the chamber 94. As will be discussed in further detail hereinafter, the chamfer 81 minimizes the problems previously associated with the powder cup skirt 77 catching on the basewad 52 by providing a clearance between the edges of the powder cup skirt 77 and the skirt 80 of the basewad 52.

The ammunition cartridge 50 has a hull including the tube 51, the basewad 52, and the metallic head 53. The hull may be as described in U.S. Pat. No. 6,164,209 to Best et al., which is incorporated by reference herein in its entirety. It is contemplated, however, that other hull designs may be used. For example, hulls such as those found in commercially available WINCHESTER AA® shotshells may be used. The tube 51 is of conventional construction and may be formed of paper or plastic (e.g., polyethylene). The head 53 may similarly be of conventional construction and may be formed of steel or brass. The tube 51 has interior and exterior predominately cylindrical surfaces 54 and 55 respectively. A foremost portion 58 of the tube 51 forms a crimp enclosing a fore end of the ammunition cartridge 50.

Proximate the aft end 56 of the tube 51, the basewad 52 is contained within the tube 51. A lateral, longitudinally-extending, generally cylindrical, exterior surface 60 of the basewad 52 engages the interior surface 54 of the tube 51 in direct contact along a length thereof.

The head 53 is unitarily formed having a sleeve portion 61, an interior surface 62 of which contacts the exterior surface 55 of the tube 51. At its aft end, the sleeve portion 61 flares outward to form a rim of the ammunition cartridge 50 which compressively holds an outwardly flared aft portion of the tube 51 to a beveled shoulder or lip 64 of the basewad 52. A web portion rim to form a base of the ammunition cartridge 50. The web portion 66 has a central aperture 67 proximate which the web portion 66 is deformed forwardly. The web portion 66 contacts an aft or base surface 68 of the basewad 52.

The basewad exterior surface 60 is of a diameter effective to maintain itself in engagement with the interior surface 54 of the tube 51. By way of example, the ammunition cartridge 50 of FIG. 2 may have proportions generally corresponding to an embodiment as a 12 gauge ammunition cartridge. In the exemplary 12 gauge ammunition cartridge embodiment, the exterior surface 60 has a diameter of about 0.74 inches. As shown in further detail in FIG. 3, the interior surface 72 of the basewad 52 extends from the generally forward facing inner portion 74 forward and outward to the generally inward facing fore portion 76. An annular frustoconical bevel surface (chamfer) 78 meets the exterior surface 60 at an annular vertex 79 defining a rim at the forward extremity of the basewad 52. The chamfer 78 thus connects the fore portion 76 to the exterior surface 60. The interior surface 76, exterior surface 60 and chamfer 78 bound the skirt 80 of the basewad 52. Extending forward from a central aperture in the aft surface 68 is a primer pocket 82 formed by a stepped primer pocket surface 84. When the hull is assembled as shown in FIG. 2, a primer, such as a battery cup-type primer 86, extends through the central aperture 67 of the head 53 and into the primer pocket where the primer 86 is firmly engaged by the primer pocket surface 84.

Surrounding a fore end of the primer pocket 82, the basewad 52 includes a hub 104 bounded internally by the primer pocket surface 84 and externally by the inboard wall of an annular, generally forward-facing, channel 106. The channel has a bottom 108 located aft of the forward surface or rim 110 of the hub by a channel depth D.

Figure 4:
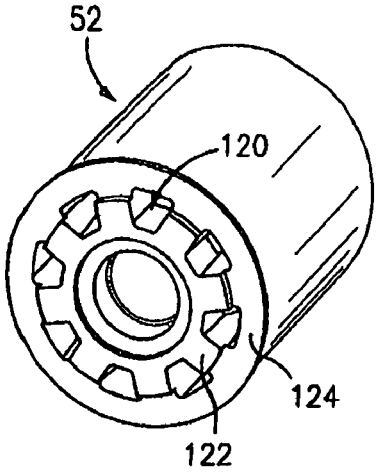
FIG. 4 (PRIOR ART)
FIG. 4 is a rear perspective view of the basewad of FIG. 3.
Figure 3:
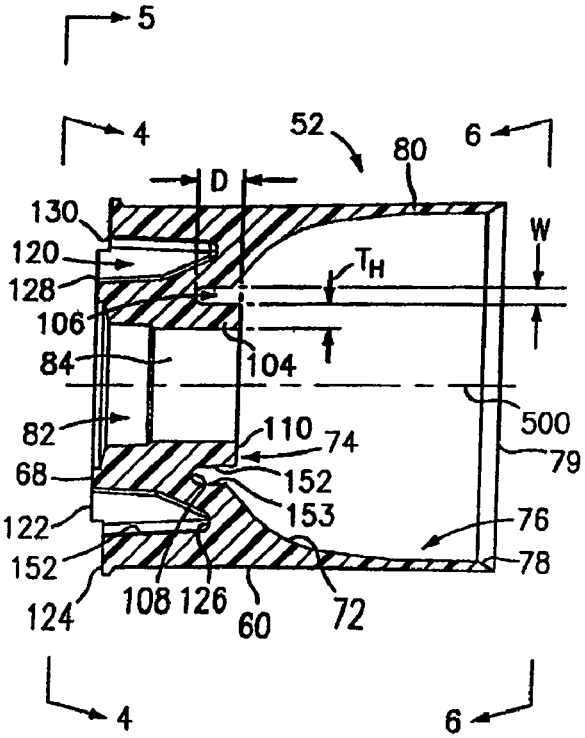
FIG. 3 (PRIOR ART)
FIG. 3 is a longitudinal sectional view of a basewad of the ammunition cartridge FIG. 2.

In the example shown in FIG. 3 and in further detail in the perspective view of FIG. 4, the basewad has a plurality (e.g., eight in the illustrated embodiment) of blind compartments 120. The compartments 120 are open to the aft surface 68 and extend forward therefrom. The compartments 120 are located on the boundary between a rearwardly projecting central portion 122 of the aft surface 68 surrounding an opening to the primer pocket and an outer portion 124 of the aft surface extending radially outward from the central portion 122 and forwardly offset therefrom. In the illustrated embodiment of FIG. 3, the compartments 120 do not reach the basewad exterior cylindrical surface 60. Optionally, the compartments may be formed entirely or partially as channels open to the basewad exterior surface 60. In alternative arrangements, the blind compartments 120 may be eliminated.

Figure 5:
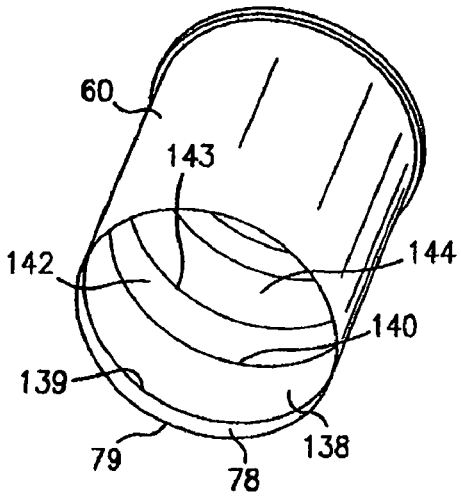
FIG. 5 (PRIOR ART)
FIG. 5 is a front perspective view of the basewad of FIG. 3.

Returning to FIG. 2, there can be seen details of the skirt 80 of the basewad 52 and its interaction with the powder cup 90. A nearly cylindrical exterior surface 136 of the powder cup 90 is in substantially continuous circumferential contact with a first interior surface portion 138 of the fore portion 76 of the basewad interior surface 72. Details of the first surface portion 138 can be seen in FIGS. 5 and 6. The first surface portion 138 extends aft from an annular junction 139 with the chamfer 78. The first surface portion 138 extends aft to a second annular junction 140 with a second surface portion 142. The first surface portion 138 is substantially frusto-conical with a fore-to-aft taper β (FIG. 6) measured as an overall forward facing cone angle between the surface and the longitudinal direction (e.g. axis 500). Advantageously, β is quite small, preferably less than three degrees, more preferably about two degrees or less, and minimum values for β may be minimum values effective to provide releaseability from a mold. This narrow range of the angle β is advantageous to allow proper telescoping of the powder cup 90 within the basewad 52, while other angles are less sensitive. For example, the chamfer 78 has a fore-to-aft taper angle θ of about thirty degrees in the exemplary embodiment. This angle is sufficiently small to guide insertion of the powder cup 90 into the basewad 52 when the ammunition cartridge 50 is loaded. The angle θ (and associated therewith, the wall thickness of the skirt 80 near the rim 79) is, however, large enough so that the skirt 80 is sufficiently robust to withstand loading, discharge, and, preferably, reloading. A broader exemplary range for θ is from about 20° to about 45°. Specifically, at the junction 139, the skirt 80 has a wall thickness t. In the exemplary embodiment, the thickness t is about 0.015 inches. Given the shallow angle β, the wall thickness does not greatly increase along the first portion 138 extending to the second junction 140 at a distance $L_1$ from the rim 79. For example, with an exemplary distance $L_1$ of 0.20 inches and an angle β of one degree, the wall thickness increases only to about 0.018 inches at the second junction 140 from the wall thickness t of 0.015 inches at the first junction 139.

Figure 6:
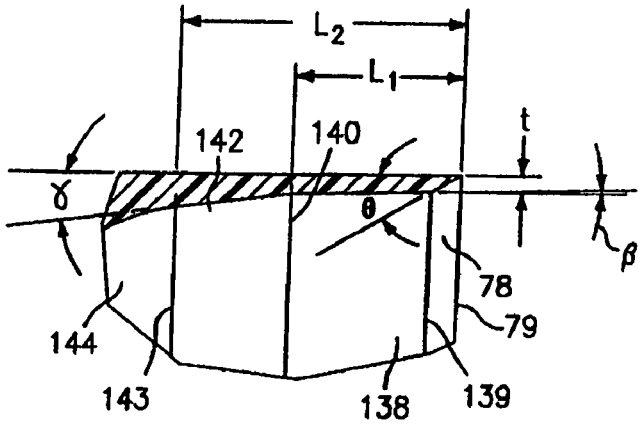
FIG. 6 (PRIOR ART)
FIG. 6 is a partial cross-sectional view of a fore end of the basewad of FIG. 3.

Proceeding aft from the second junction 140, the fore-to-aft taper further increases. In the exemplary embodiment, the second surface portion 142 has a taper angle γ (FIG. 6). As discussed in further detail below, the angle aft of the powder cup-engaging portion of the basewad may vary significantly based upon the application for which the basewad is designed. An exemplary angle γ for a basewad defining a relatively voluminous powder chamber is about seven degrees as shown in the embodiment of FIG. 6. In the illustrated embodiment, the second surface portion 142 extends aft from the second junction 140 to a third junction 143 with a curving portion 144 of the interior surface along which the taper further increases.

Figure 7:
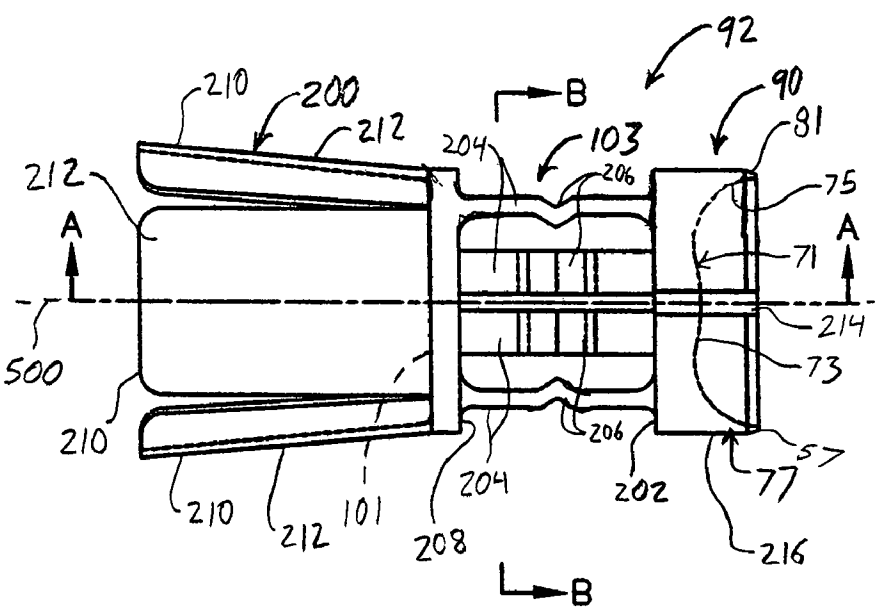
FIG. 7 is a side elevation view of a projectile wad of the ammunition cartridge of FIG. 2.

Referring now to FIG. 7, a side elevation view of the projectile wad 92 is shown. The projectile wad 92 includes three main portions: the powder cup 90, the compressible mid section 103, and a projectile cup 200. The projectile wad 92 is preferably a unitary structure made from plastic (e.g., polyethylene).

The mid section 103 is attached to a forward facing surface 202 of the powder cup 90. The mid section includes a plurality of spring members 204, which in this embodiment are in the form of collapsible columns. The spring members 204 include bent portions 206 that allow the columnar spring members 204 to buckle during loading to provide compensation for variations in load volumetric fit (e.g., variations in the projectile or powder charge). Hinge compressibility of the spring members 204 also helps optimize ballistic performance and absorb shock load, which is transmitted substantially in the direction of longitudinal axis 500.

Figure 8:
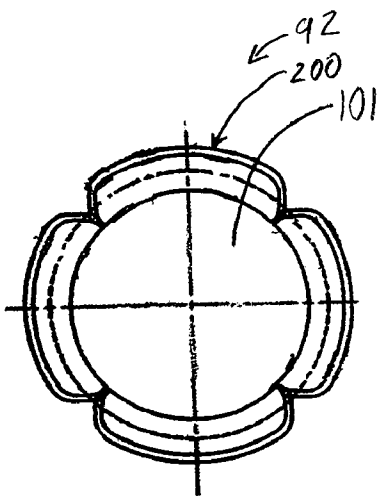
FIG. 8 is a front elevation view of the projectile wad of FIG. 7.

The projectile cup 200 includes an aft facing surface 208, which is attached to the foreward ends of the spring members 204. The projectile cup 200 also includes the forward facing surface 101 upon which one or more projectiles (e.g., a slug or shot) rests in the fully-assembled ammunition cartridge 50 (FIG. 2). Extending forwardly from the surface 101 are a plurality of petals, which cooperate to form sides of the projectile cup 200. FIG. 7 depicts the shot-wad 92 in an unloaded condition, outside of the tube 51. As can be seen in FIG. 7, the petals are angled outwardly relative to the planar surface 101. Upon insertion of the projectile wad 92 into the tube 51, an outside surface 212 of each of the petals 210 contacts the interior surface 54 (FIG. 1) of the tube 51 and the petals 210 are straightened such that the outside surfaces 212 of the petals 210 are generally perpendicular to the surface 101. FIG. 8 is a front elevation view of the projectile wad 92 showing the petals 210 extending from the surface 101.

Figure 1:
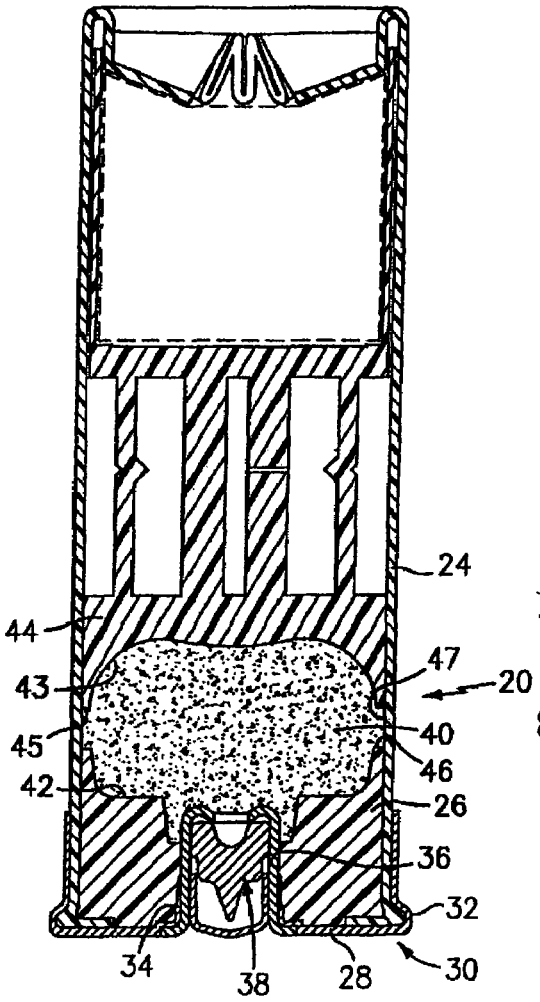
FIG. 1 (PRIOR ART)
FIG. 1 is a longitudinal sectional view of a prior art ammunition cartridge.
Figure 9:
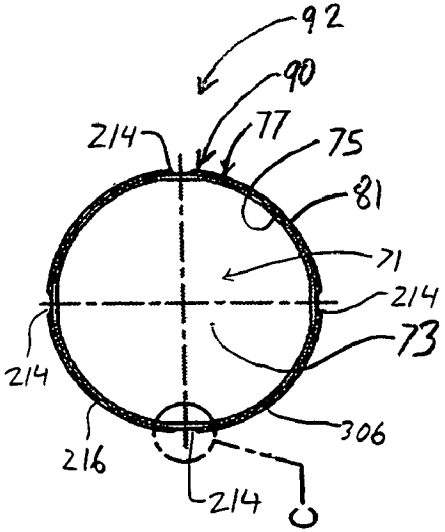
FIG. 9 is a rear elevation view of the projectile wad of FIG. 7.

As can be seen in FIG. 7, the powder cup 90 is defined by the interior surface 71, which extends outward and rearward from the generally aft facing inner portion 73 to the generally inward facing aft portion 75 so as to define the skirt 77. Disposed around the outer perimeter of the lip 57 of the skirt 77 is the chamfer 81. As can be seen in FIGS. 7 and 9, a plurality of equally-spaced channels 214 are disposed in an outside surface 214 of the skirt 77. In the embodiment shown, four channels 214 are disposed in the outside surface 214. The channels 214 act as air vents to prevent the buildup of air pressure in the chamber 94 during the loading process, when the powder cup skirt 77 is being inserted in the skirt 80 of the basewad 52 (FIG. 1).

Figure 10:
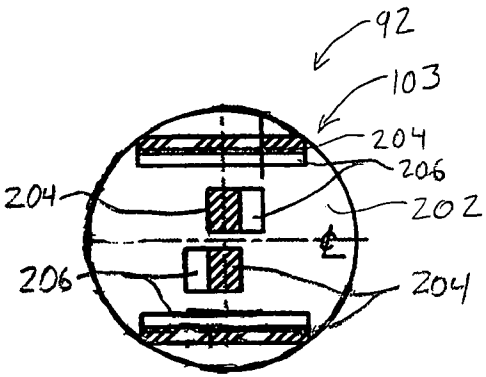
FIG. 10 is a section view of the projectile wad taken along section B—B of FIG. 7.

Referring now to FIG. 10, a transverse section view of the mid portion 103 is shown. As can be seen in FIG. 10, four spring members 204 are used. Two of the spring members 204 are located near the center of the surface 202, and the remaining two larger spring members are located near the perimeter of surface 202. The arrangement, size, and location of the spring members 204 may be selected based on the amount of compressibility or shock absorption desired.

Figure 11:
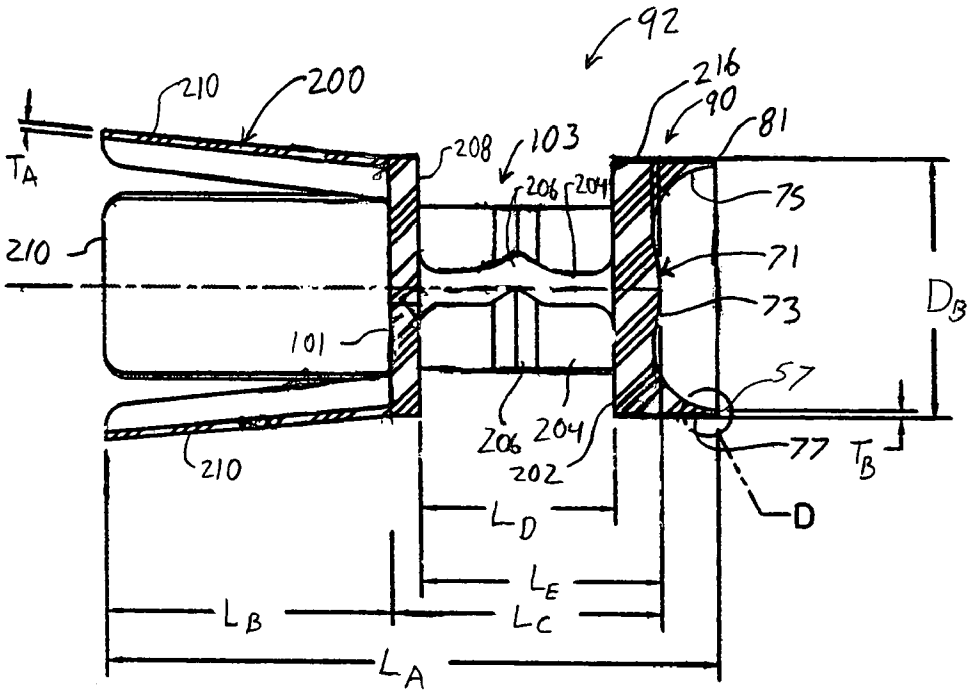
FIG. 11 is a section view of the projectile wad taken along section A—A of FIG. 7.

Referring to FIG. 11, a longitudinal section view of the projectile wad 92 is shown. The powder cup 90 has an outer surface 216, which has a diameter, indicated at $D_B$ effective to maintain itself in engagement with the first interior surface portion 138 of the fore portion 76 of the basewad interior surface 72 (FIG. 3) while allowing the powder cup skirt 77 to be slidably received within the skirt 80 of the basewad 52, as shown in FIG. 2. For example, in the exemplary 12 gauge ammunition cartridge embodiment, the powder cup 90 preferably has a diameter $D_B$ of between about 0.690 inches to about 0.712 inches, and more preferably between about 0.695 inches to about 0.710 inches. In another example, for a 20 gauge ammunition cartridge embodiment, the diameter $D_B$ is preferably between about 0.580 inches to about 0.600 inches, and more preferably between about 0.585 inches to about 0.595 inches.

It has been determined that the ability of the powder cup skirt 77 to adequately seal combustion gasses within the chamber 94 is largely dependent upon the powder cup skirt 77 thickness, indicated at $T_B$, at the transition point between the outer surface 216 and the chamfer 81. Preferably, the thickness $T_B$ is between about 0.015 inches to about 0.028 inches, and more preferably between about 0.018 inches to about 0.024 inches. Surprisingly, it has been determined that these thicknesses are applicable to both 12 and 20 gauge embodiments, regardless of the outside diameter $D_B$.

In the exemplary 12 gauge ammunition cartridge embodiment: the overall length of the projectile wad 92, indicated at $L_A$, may be between about 1.685 inches to about 1.655 inches; the length of the petals 210, indicated at $L_B$, may be between about 0.795 inches to about 0.775 inches; the distance between surfaces 73 and 101, indicated at $L_C$, may be about 0.735 inches; the length of spring members 204, indicated at $L_D$, may be about 0.530 inches; and the distance between surfaces 208 and 73, indicated at $L_E$, may be about 0.655 inches. The petals 210 preferably have a thickness $T_A$ of between about 0.017 inches to about 0.023 inches. The projectile cup 200 (with petals 200 in the closed, loaded position) may have the same outside diameter as the outside diameter $D_B$ of the projectile wad 92.

In the exemplary 20 gauge ammunition cartridge embodiment: the overall length of the projectile wad 92, indicated at $L_A$, may be about 1.695 inches; the length of the petals 210, indicated at $L_B$, may be about 0.830 inches; the distance between surfaces 73 and 101, indicated at $L_C$, may be about 0.690 inches; the length of spring members 204, indicated at $L_D$, may be about 0.520 inches; and the distance between surfaces 208 and 73, indicated at $L_E$, may be about 0.620 inches. The petals 210 preferably have a thickness $T_A$ of about 0.031 inches. The projectile cup 200 (with petals 200 in the closed, loaded position) may have the same outside diameter as the outside diameter $D_B$ of the projectile wad 92.

Figure 12:
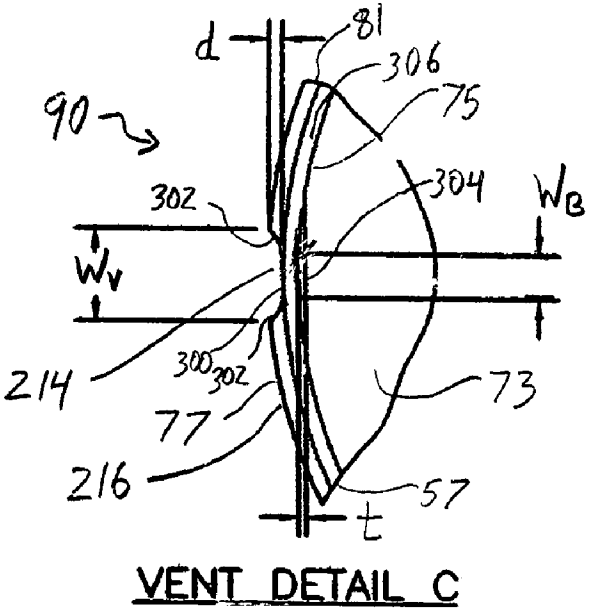
FIG. 12 is an end view of a vent disposed in a powder cup of the projectile wad taken at detail C of FIG. 8.

Referring to FIG. 12, a detailed end view of the lip 57 of the powder cup skirt 77 is shown. As can be seen in FIG. 12, the vent 214 extends into the outer surface 216 to a depth d, which is less than the thickness $T_B$ of the powder cup skirt 77. The vent 214 is defined by a substantially planar base surface 300 and outwardly extending side surfaces 302. The width of base surface 300 is indicated at $W_B$ and the overall width of the vent 214 is indicated at $W_V$. Disposed behind the vent 214 at the aft portion 75 of skirt 77 is an increased thickness portion 304, which acts to prevent the skirt 77 from splitting along the channel 214. The increased thickness portion 304 has a thickness indicated at t. The width $W_B$ is preferably about 0.30 inches; the width $W_V$ is preferably about 0.062 inches; the depth d is preferably between about 0.008 to about 0.012 inches; and the thickness t is preferably about 0.005 inches.

Figure 13:
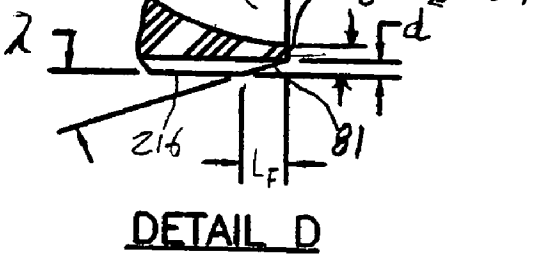
FIG. 13 is a cross-sectional view of the vent disposed in the powder cup of the projectile wad taken at detail D of FIG. 10.

Referring to FIG. 13, a detailed side section view of the lip 57 of the powder cup skirt 77 is shown. As can be seen in FIG. 13, the chamfer 81 has a forward facing cone angle, indicated at $\lambda$ of about 18 degrees relative to the outer surface 216 of the skirt 77. The chamfer 81 is separated from the aft portion 75 of skirt 77 by an end surface 306 of the lip 57. Preferably, the transition point between the outer surface 216 and the chamfer 81 is at a distance from the end surface 306, as indicated at $L_F$, equal to about 0.030 inches. These dimensions provide a clearance at the lip 57, as indicated at d, of about 0.010 inches, which helps to insure undisturbed entry of the lip 57 into the basewad 52 mouth without catching on any deformations in the basewad 52 mouth. Accordingly, the chamfer 81 helps to ensure that the powder cup 90 remains in proper alignment when the powder cup skirt 77 is slidably inserted into the basewad 52 mouth during the loading process. As a result, the chamfer 81 alleviates problems associated with improperly aligned powder cups, such as low report on firing and bulges in the ammunition cartridge 50 sidewall that can prevent chambering in the shotgun.

Also, in the embodiment of FIGS. 9, 12, and 13, the end surface 306 of the lip 57 is substantially uninterrupted around the skirt 77. That is, the end surface 306 of the lip 57 is substantially free of any notches or slots. It has been surprisingly found that the substantially uninterrupted end surface 306 allows for improved powder cup 90 alignment compared to projectile wads having an end surface 306 that is slotted or notched.

Figure 14:
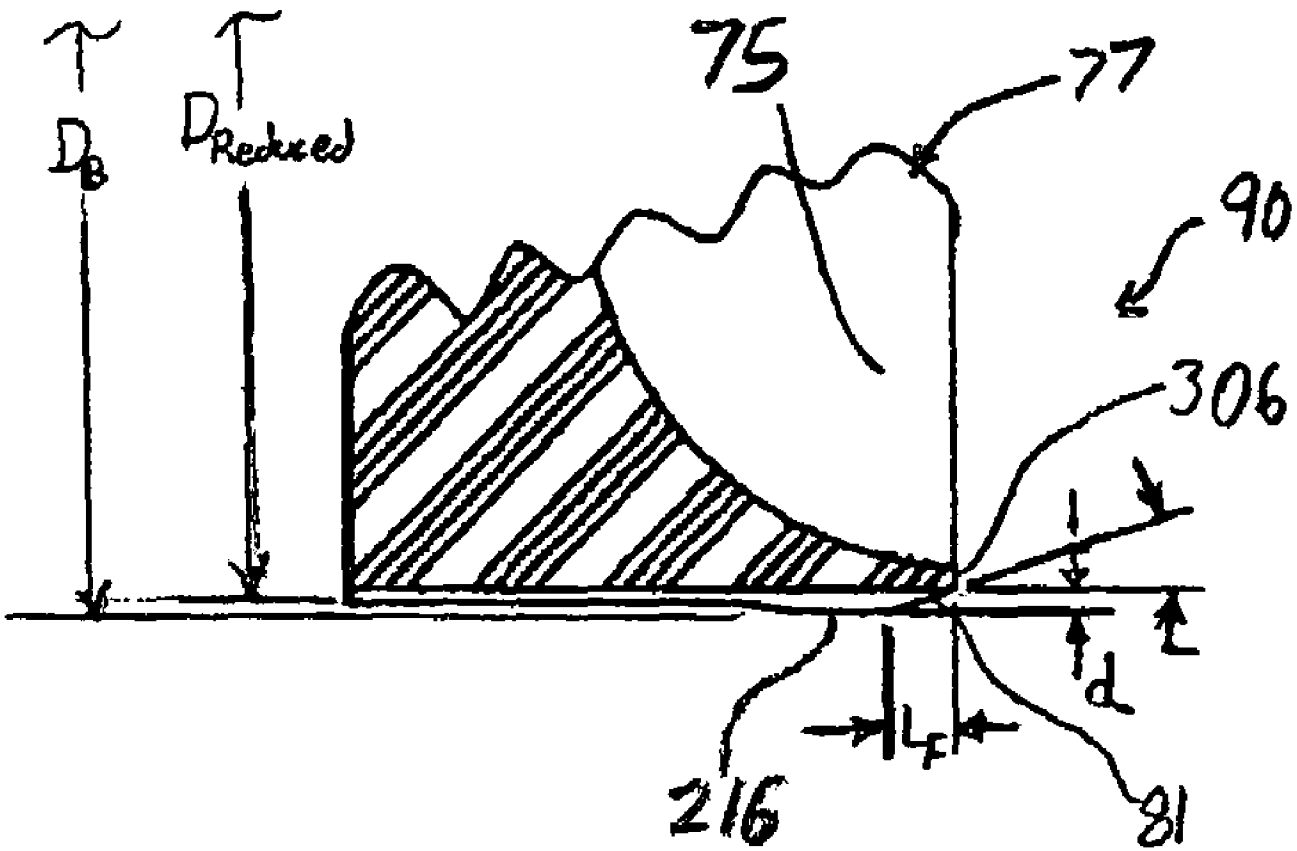
FIG. 14 is a cross-sectional view of a powder cup skirt having a reduced diameter portion.

Referring to FIG. 14, a detailed side section view of the lip 57 of the powder cup skirt 77 is shown wherein the forward portion of the powder cup skirt 77 has a reduced outside diameter area, with the reduced outside diameter being indicated at $D_{reduced}$. The reduced outside diameter area minimizes the interference fit between the outer surface 216 of the powder cup 90 and the first interior surface portion 138 of the fore portion 76 of the basewad interior surface 72 (FIG. 3) to prevent bulging at the outside of tube 51 in this vicinity.

Referring again to FIG. 2, the propellant 96 may be any propellant suitable for the desired application of ammunition cartridge 50. Suitable propellants include, for example, the WINCHESTER SUPER-TARGET® and SUPER-FIELD® lines of BALL POWDER® smokeless propellant of Olin Corporation, East Alton, Ill. (BALL POWDER being a trademark used under license from Primex Technologies, Inc., St. Petersburg, Fla.).

The projectile 100 may be any one or more projectiles suitable for the desired application of ammunition cartridge 50. For example, projectile 100 may include a single slug or multiple shot formed from any suitable material (e.g., lead). Other examples of projectiles 100 include non-lethal projectiles such as: a solid rubber slug or multiple rubber shot; a liquid filled projectile having an elastomeric or other flexible casing surrounding a liquid core; a plurality of solid particles encased in an elastomeric or otherwise flexible cover or casing (e.g. a "bean bag" filled with a powder, granules, pellets and the like); a projectile having a sponge or other solid foam tip extending forward from a relatively solid and rigid body; a projectile having an elastomeric or other flexible casing surrounding a foam core; and wooden slugs and batons.

Prior to firing of the ammunition cartridge 50, the propellant charge 96 is substantially encapsulated by a combination of the powder cup 90, basewad 52, and primer 86. Preferably, none of the propellant is in direct contact with the tube 51 or, more particularly, its interior surface 54. Such encapsulation helps prevent sifting of the powder out of the chamber 94 and between the basewad 52 and the tube 51. Such encapsulation may also help to prevent moisture infiltration into the chamber 94. In firing the ammunition cartridge 50, when the user causes the primer 86 to ignite and, thereby, ignite the propellant 96, pressure within the powder chamber 94 greatly increases. Such pressure produces a forward force on the powder cup 90, tending to drive the powder cup 90 forward, out of the basewad 52. After an initial compression of the midsection 103 (if any), forward movement of the powder cup 90 is translated to the projectile cup 200, tending to propel the projectile wad 92 and projectile(s) 100 forward, out of the hull and down the barrel of the shotgun. The pressure increase also produces a radially outward force on the powder cup 90 particularly adjacent to the lip 57 of the powder cup skirt 77. Such radially outward force strains the powder cup 90 causing the powder cup 90 to expand radially and bear against the first surface portion 138 of the basewad 52, the interior surface 54 of the tube 51, and gun barrel, thereby maintaining a seal against escape of propellant combustion gases.

Given the compliance of the basewad 52, such radially outward force also causes the basewad 52 (particularly proximate the forward rim 79 thereof to expand radially into firm(er) engagement with the interior surface 54 of the tube 51. This firm engagement is believed to help resist the rearward infiltration of combustion gases between the basewad 52 and tube 51 once the powder cup 90 has disengaged from the basewad 52.

Additionally, when the ammunition cartridge 50 is fired, the pressure within the powder chamber 94 extends within the channel 106, pressing the hub 104 radially inward, causing the adjacent portion of the primer pocket surface 84 to bear more firmly against the primer 86 reducing the probability of combustion gas infiltration between the primer 86 and the primer pocket surface.

The advantages of the present invention will become apparent from the examples that follow. The following examples are intended to illustrate, but in no way limit the scope of the present invention.

EXAMPLES

In a first comparative example, 12 gauge ammunition cartridges were manufactured with a 1⅛ ounce wad similar to the 12-gauge configuration described hereinabove with the exception that in the ammunition cartridges of the first comparative example four gaps were disposed through the chamfer, 90 degrees apart and in line with air vents on the powder cup. Each of the air vents extended from the inward facing aft portion 75 through the chamfer and defined a notch in the end surface 306 of the powder cup 90. Approximately 35 million projectile wads of this design were used in production field loads. The 12 gauge ammunition cartridges of the first comparative example provided little improvement in the frequency of tipped powder cups for loads over that obtained with non-chamfered powder cups of the prior art.

In a second comparative example, 12 gauge ammunition cartridges were manufactured with a 1⅛ ounce wad similar to the 12-gauge configuration described hereinabove with the exception that the powder cup skirt thickness $T_B$ was increased to between 0.028 inches and 0.032 inches with a powder cup skirt diameter $D_B$ between 0.692 inches and 0.702 inches. The 12 gauge ammunition cartridges of the second comparative example provided unacceptable occurrences of low reports on firing, even with properly seated projectile wads. While not wanting to be bound by theory, it is believed that powder cup skirts with a thickness $T_B$ of greater than 0.028 inches are less effective than thinner powder cup skirts in sealing propulsion gasses because of the decreased pliability of the skirt. The reduced outer diameter and decreased pliability in the powder cup skirts of the second comparative example does not allow sufficient radial expansion of the powder cup skirt as the wad travels down the shell and gun barrel to maintain a seal against escape of propellant combustion gases.

In a first example of an embodiment of the present invention, 12 gauge ammunition cartridges were manufactured with a 1⅛ ounce projectile wad in accordance with the 12-gauge configuration described hereinabove. 5000 rounds were shot at 70 degrees with no wad-related problems. Approximately 120 rounds were shot at 70, 125, 20 and 0 degrees for wad recovery, with no defects found. Only one shell was found to have a misaligned wad, which was found to be caused by a deformation in the basewad mouth. This one defective shell accounted for only 0.01% of the shells produced with the 1⅛ ounce projectile wad in accordance with the 12-gauge configuration described hereinabove. Historically, misaligned projectile wads account for a 0.029% to 1% defect rate where non-chamfered, prior art projectile wads are used. In conclusion, it is believed that this testing shows ballistic performance of this first example to be equivalent to the ballistic performance provided by the non-chamfered, prior art projectile wads, while the frequency of misaligned projectile wads is significantly lower.

Although one or more embodiments of the present invention have been described, it will nevertheless be understood that various modifications may be made without departing from the spirit and scope of the invention. For example, the dictates of particular end uses may influence certain parameters of the projectile wad as well as the remainder of the ammunition cartridge. Also, adaptations may be made relative to the type of ammunition cartridge to which the projectile wad of the invention is applied (e.g., gauge and shell length). Thus, the principles of the invention may be applied to shells other than those illustrated, for example, to 8-gauge shells used in industrial applications. Accordingly, other embodiments are within the scope of the following claims.

What is claimed is:

1. An ammunition cartridge comprising: a tube extending along a central longitudinal axis from an aft end of the tube to a fore end of the tube; a basewad disposed within the tube and located proximate the aft end of the tube, the basewad including: an interior surface extending outward and forward from a generally forward facing inner portion to a generally inward facing fore portion so as to define a skirt of the basewad; a projectile wad disposed within the tube, the projectile wad including: a forward facing surface, and an interior surface extending outward and rearward from a generally aft facing inner portion to a generally inward facing aft portion so as to define a powder cup skirt, the powder cup skirt having: a lip having an end surface, the end surface being substantially uninterrupted around the entire powder cup skirt, and a chamfer formed around an outer perimeter of the lip, the lip being slidably received within the skirt of the basewad so as to form a chamber between the powder cup skirt and the skirt of the basewad; a propellant charge disposed within the chamber; and at least one projectile disposed within the tube between the forward facing surface of the projectile wad and the fore end of the tube.

2. The cartridge of claim 1, wherein the powder cup skirt has a thickness T.sub.B at a transition point between the outer surface of the power cup skirt and the chamfer, the thickness T.sub.B being between about 0.015 inches to about 0.028 inches.

3. The cartridge of claim 2, wherein the thickness T.sub.B is between about 0.018 inches to about 0.024 inches.

4. The cartridge of claim 2, wherein the powder cup skirt has an outside diameter of between about 0.690 inches to about 0.712 inches.

5. The cartridge of claim 4, wherein the powder cup skirt has an outside diameter of between about 0.695 inches to about 0.710 inches.

6. The cartridge of claim 2, wherein the powder cup skirt has an outside diameter of between about 0.580 inches to about 0.600 inches.

7. The cartridge of claim 6, wherein the powder cup skirt has an outside diameter of between about 0.585 inches to about 0.595 inches.

8. The cartridge of claim 1, wherein the chamfer has a forward facing cone angle of about 18 degrees relative to the central longitudinal axis.

9. The cartridge of claim 8, wherein the transition point between the outer surface and the chamfer is about 0.30 inches from the end surface of the lip.

10. The cartridge of claim 9, wherein the lip has a thickness of about 0.10 inches at the end surface of the lip.

11. The cartridge of claim 1, wherein the projectile wad further includes: a plurality of petals disposed at a perimeter of the forward facing surface, the at least one projectile being disposed between the plurality of petals.

12. The cartridge of claim 1, wherein the projectile wad further includes: a compressible shock absorbing midsection disposed between the forward facing surface and the interior surface of the projectile wad.

13. The cartridge of claim 1, wherein the projectile wad further includes: a plurality of evenly spaced channels disposed along an outer surface of the powder cup skirt.

14. A projectile wad for an ammunition cartridge, the projectile wad being formed as a unitary structure comprising: a forward facing surface adapted to support at least one projectile; a compressible shock absorbing midsection disposed between the forward facing surface and an interior surface of the projectile wad; and an interior surface extending outward and rearward from a generally aft facing inner portion to a generally inward facing aft portion so as to define a powder cup skirt, the powder cup skirt having: a lip having an end surface, the end surface being substantially uninterrupted around the entire powder cup skirt, and a chamfer formed around an outer perimeter of the lip, the lip being dimensioned for slidable receipt within a skirt of a basewad so as to form a chamber between the powder cup skirt and the skirt of the basewad for receiving a propellant.

15. The projectile wad of claim 14, wherein the powder cup skirt has a thickness T.sub.B at a transition point between the outer surface of the power cup skirt and the chamfer, the thickness T.sub.B being between about 0.015 inches to about 0.028 inches.

16. The projectile wad of claim 15, wherein the thickness T.sub.B is between about 0.018 inches to about 0.024 inches.

17. The projectile wad of claim 15, wherein the powder cup skirt has an outside diameter of between about 0.690 inches to about 0.712 inches.

18. The projectile wad of claim 17, wherein the powder cup skirt has an outside diameter of between about 0.695 inches to about 0.710 inches.

19. The projectile wad of claim 15, wherein the powder cup skirt has an outside diameter of between about 0.580 inches to about 0.600 inches.

20. The projectile wad of claim 19, wherein the powder cup skirt has an outside diameter of between about 0.585 inches to about 0.595 inches.

21. The projectile wad of claim 14, wherein the chamfer has a forward facing cone angle of about 18 degrees relative to the projectile wad's central longitudinal axis.

22. The projectile wad of claim 21, wherein the transition point at the outer surface and chamfer is about 0.30 inches from the end surface of the lip.

23. The projectile wad of claim 22, wherein the lip has a thickness of about 0.10 inches at the end surface of the lip.

24. The projectile wad of claim 14, further comprising: a plurality of petals disposed at a perimeter of the forward facing surface, the at least one projectile being received between the plurality of petals.

25. The projectile wad of claim 14, further comprising: a plurality of evenly spaced channels disposed along an outer surface of the powder cup skirt.

26. A projectile wad for an ammunition cartridge, the projectile wad being formed as a unitary structure comprising: a forward facing surface adapted to support at least one projectile; and an interior surface extending outward and rearward from a generally aft facing inner portion to a generally inward facing aft portion so as to define a powder cup skirt, the powder cup skirt having: a lip having an end surface, the end surface being substantially uninterrupted around the entire powder cup skirt, a chamfer formed around an outer perimeter of the lip, and an outer surface having a maximum diameter adjacent the chamfer, the maximum diameter adjacent the lip being dimensioned for slidable receipt within a portion of a tapered inner surface of the skirt of a basewad, such that the maximum diameter of the outer surface maintains itself in engagement with the inner surface of the basewad skirt to form a chamber between the powder cup skirt and the skirt of the basewad for receiving a propellant.

* * * * *

UNITED STATES PATENT AND TRADEMARK OFFICE

CERTIFICATE OF CORRECTION

PATENT NO. : 7,150,229 B2
APPLICATION NO. : 10/832879
DATED : December 19, 2006
INVENTOR(S) : Robert J. Gardner It is certified that error appears in the above-identified patent and that said Letters Patent is hereby corrected as shown below:

In Column 2, line 54, change “0.30” to -- 0.030 --
In Column 2, line 56, change “0.10” to -- 0.010 --
In Column 7, line 52, change “0.30” to -- 0.030 --
In Claim 9, change “0.30” to -- 0.030 --
In Claim 10, change “0.10” to -- 0.010 --
In Claim 22, change “0.30” to -- 0.030 --
In Claim 23, change “0.10” to -- 0.010 --

Signed and Sealed this

Twenty-ninth Day of May, 2007

JON W. DUDAS
*Director of the United States Patent and Trademark Office*